United States Patent [19]

Shields

[11] 4,116,310

[45] Sep. 26, 1978

[54] COMBINED SHOULDER STRAP BAG AND CUSHION

[76] Inventor: Mary J. Shields, P.O. Box 207, Hastings, Mich. 49058

[21] Appl. No.: 781,526

[22] Filed: Mar. 25, 1977

[51] Int. Cl.[2] ..... A45C 15/00

[52] U.S. Cl. ..... 190/42; 5/341; 150/33; 190/52

[58] Field of Search ..... 190/42, 8, 52; 150/28 R, 30, 33, 34, 35; 5/341

[56] References Cited

U.S. PATENT DOCUMENTS

| | | | |
|---|---|---|---|
| 1,549,647 | 8/1925 | Worthington | 190/8 |
| 1,742,186 | 1/1930 | Claus | 5/341 |
| 2,140,333 | 12/1938 | Reiter | 150/33 |
| 3,139,632 | 7/1964 | Johns | 5/341 |
| 3,175,230 | 3/1965 | Herdal | 5/341 |
| 3,340,969 | 9/1967 | Rothberg | 5/341 |
| 3,696,850 | 10/1972 | Rosenblum | 150/33 |

FOREIGN PATENT DOCUMENTS

| | | | |
|---|---|---|---|
| 399,944 | 10/1933 | United Kingdom | 150/33 |
| 437,567 | 10/1935 | United Kingdom | 150/33 |

*Primary Examiner*—Ro E. Hart

*Attorney, Agent, or Firm*—Clarence A. O'Brien; Harvey B. Jacobson

[57] ABSTRACT

A combined cushion and article carrier, the invention particularly provides a foam cushion held within a bag-like fabric covering, the fabric covering having a shoulder strap connected thereto to facilitate carrying thereof. The foam cushion has an indentation or pocket formed in one planar face thereof for receiving articles such as a closable cup for bingo paraphernalia, and the like, the indentation being surmounted by a zippered closure for ready access to the enclosed articles. The cushion may be used as a seat cushion when playing bingo or as a pillow when traveling such as by bus, train, airplane, or the like. When used as a pillow, money, important documents or other valuable possessions may be placed in the pocket and thus protected from theft.

7 Claims, 4 Drawing Figures

COMBINED SHOULDER STRAP BAG AND CUSHION

BACKGROUND AND SUMMARY OF THE INVENTION

The present invention relates to portable seat cushions useful for indoor or outdoor situations wherein cushioning of individual seating arrangements on benches, chairs, stools, and the like, are desired. The invention particularly further provides carrying means for the seat cushion itself and means for carrying and retaining articles within the seat cushion even during use thereof as a seat cushion without damage to the articles or discomfort to the user of the cushion.

Portable seat cushions have previously been provided with handles, straps, and the like, which faciliatate carrying of the cushion itself. The prior art has further provided pockets, and the like, on the surfaces of seat cushions so that articles could be stored and carried in said pockets. In order to use the seat cushion as a seat cushion, it is necessary to remove these articles from the pockets if said articles are fragile or if the articles are sufficiently bulky or hard to cause discomfort to the user of the seat cushion. The following U.S. patents illustrate the known developments in this art:

U.S. Pat. Nos.: 1,549,647 — Aug. 11, 1925
U.S. Pat. Nos.: 1,776,983 — Sep. 30, 1930
U.S. Pat. Nos.: 2,413,828 — Jan. 7, 1947
U.S. Pat. Nos.: 2,580,904 — Jan. 1, 1952
U.S. Pat. Nos.: 2,618,790 — Nov. 25, 1952
U.S. Pat. Nos.: 2,837,145 — June 3, 1958
U.S. Pat. Nos.: 3,297,119 — Jan. 10, 1967
U.S. Pat. Nos.: 3,696,850 — Oct. 10, 1972.

The present seat cushion resolves the shortcomings of the prior art by providing inter alia an indentation in a foamed seat cushion, which indentation is shaped to conform to the exterior configuration of an article which is to be carried within the confines of a covering surrounding the foamed seat cushion. A user of the seat cushion can, therefore, seat himself on the cushion without the need to remove articles which have previously been stored or carried within the seat cushion.

Accordingly, it is a primary object of the invention to provide a combined seat cushion and article carrier which can be used with greater facility and comfort when articles are stored therein.

It is another object of the invention to provide a combined seat cushion and article carrier having shoulder straps or other handling means for facilitating transportation thereof by a user.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
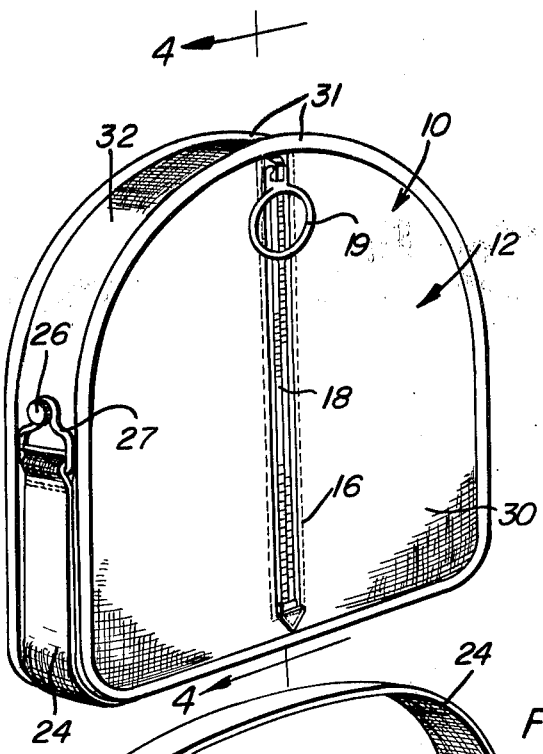
FIG. 1 is a perspective view of the front face of the present seat cushion and article carrier, the shoulder strap being fitted about a portion of the periphery thereof.
Figure 2:
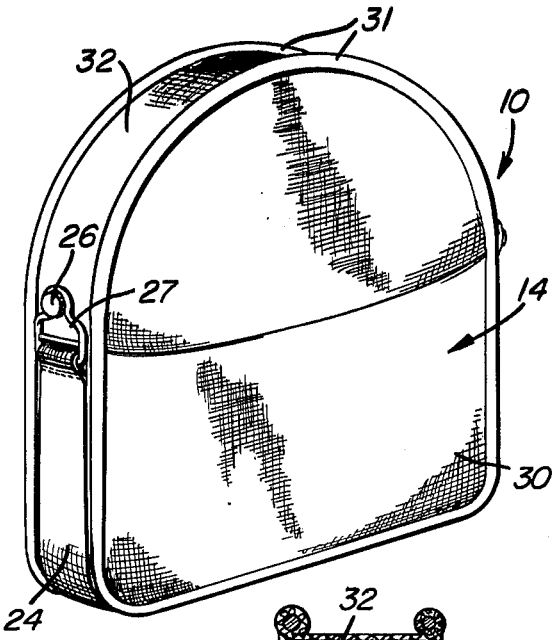
FIG. 2 is a perspective view of the opposite face of the seat cushion.
Figure 4:
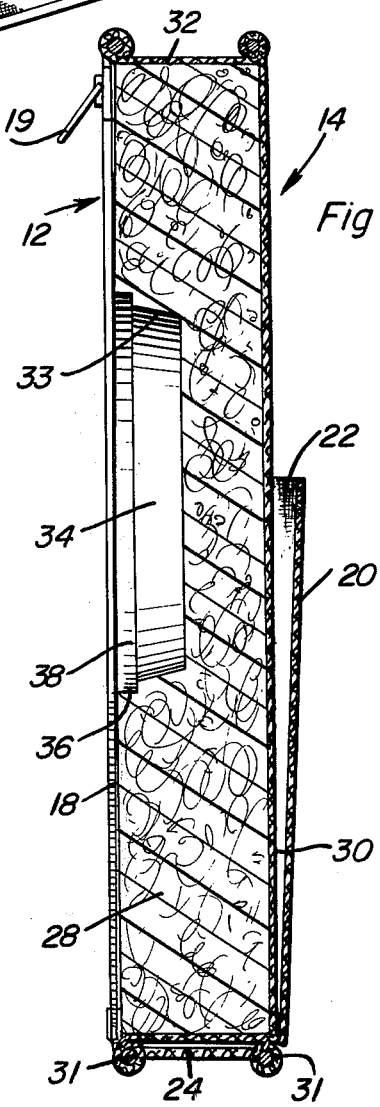
FIG. 4 is a sectional view taken generally along section line 4—4 of FIG. 1.

Referring now to the drawings and particularly to FIGS. 1 and 2, the major faces of the exterior of the present seat cushion 10 is seen at 12 and 14, respectively. Face 12 is seen to be provided with a longitudinally extending opening 16 which is closable by means of a zipper 18 having a ring-type handle 19 on the slider. Face 14 is seen to be provided with a pocket 20 in which an article may be inserted through the top opening 22 as seen in FIG. 4. The seat cushion 10 is provided with a shoulder strap 24 mounted thereto on opposite upper perimetric edges thereof by means of a button 26 of the stud type and a well-known buckle type fastener 27 such as that used on the end of a bib strap on bib overalls. The strap 24 is of a length which is essentially identical to the perimetric distance about the periphery of the bottom portion of the seat cushion 10 between the two points of connection of the strap 24 to said cushion. This perimetric distance is taken to be that distance taken around the lower portion of the cushion 10. As seen clearly in FIG. 1, provision of the length of the strap 24 as indicated results in the strap being readily "stored" and caused to be placed out of entangling or bothersome relationship to a user of the cushion 10. The strap 24 can be completely removed from the seat cushion 10, as desired, by a user thereof in which event, the cushion can be carried by inserting a finger through ring 19.

The seat cushion 10 preferably comprises a formed foam body 28 which is encased by a covering 30. The foam body 28 can be formed of rubber, foamed plastics, or any other material suitable to such use as is well-known in the art. The body 28 typically has dimensions approximating a 12 inches by 12 inches square and 2 inches thick, the top of the body being curved into generally a semicylindrical configuration. In effect, the body 28 can be formed as a rectangular solid, a circular solid, or in any other conformation suitable as a seat cushion for the human body. The covering 30 can be comprised of a sewn fabric, plastic, or other suitable material with peripheral rib type seams 31 joining the front and rear portions of cover 30 to the edge portion 32.

Figure 3:
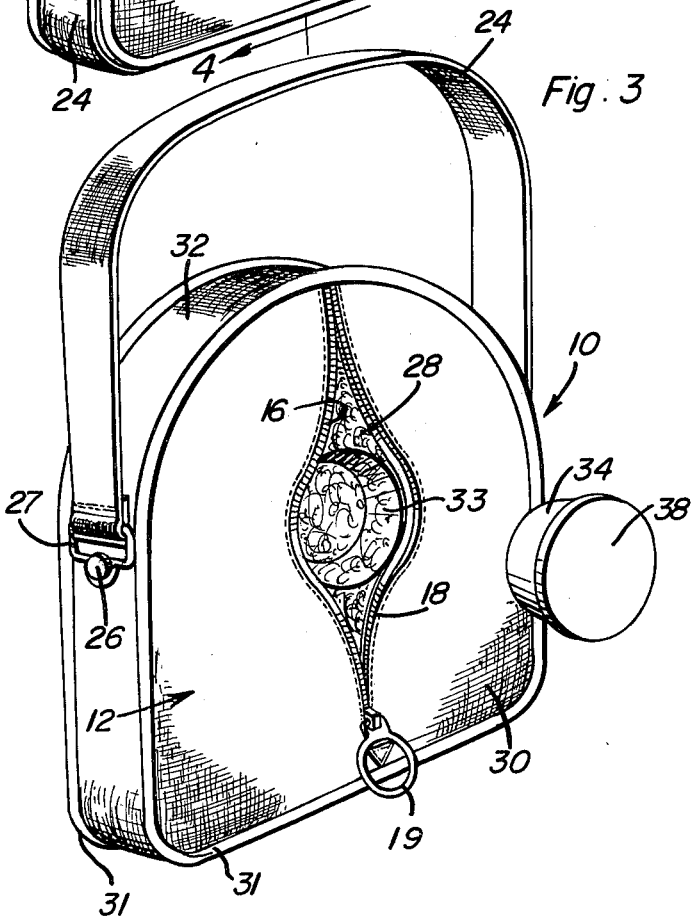
FIG. 3 is a perspective view of the present seat cushion illustrating the full deployment of the shoulder strap and the indentation formed in the seat cushion for receipt of articles which are to be carried.

Referring now to FIGS. 3 and 4, the opening 16 which is closable by means of the zipper 18 can be understood to be formed in the covering 30. The opening 16 is further seen to surmount a formed indentation 33 which is recessed in the foam body 28. Although the indentation 33 is shown in the drawings as being generally shaped like the frustum of a right circular cone, the indentation could alternately be cylindrical, conical, pyramidal, shaped as a rectangular solid, or otherwise. The indentation 33 preferably receives a shaped article 34 which fits flushly within said indentation. The article 34 of FIGS. 3 and 4 is seen to be cup shaped in the manner of the frustum of a right circular cone. The cup-like article 34 and the indentation 33 are shaped and sized such that the article 34 is completely received within the indentation 33, the top of the article lying essentially in the plane of the surface of the face 12. Thus, no portion of the article 34 protrudes from the geometrically defined confines of the foam body 28. A user of the seat cushion 10 can, therefore, store the article 34 within the covering 30 of the cushion and still use the cushion as a seating pad without damage to the article or discomfort. Damage to the article 34 is prevented under normal weight loads due to the even distribution of forces over the entire surface of the article through the full surface wall areas of the indentation 33. It is to be understood that the seat cushion 10 could also be used as desired by a user to place articles within the indentation 33 which do not conform to the shape of the indentation. Even under such circumstances, the formed indentation will provide some measure of protection for the articles.

As particularly seen in FIG. 4, the indentation 33 can be formed with a recessed annular lip 36 which is adapted to receive the overhanging portion of a plate-like closure 38 for the cup-like article 34. The article 34 can be seen to provide an excellent storage container for small articles, such as bingo chips and other bingo paraphernalia, and the like. The user of the combined seat cushion and article carrier can easily carry the seat cushion 10 by means of the strap 24 with the article 34 stored therein. When the article 34 is to be removed from storage, the zipper 18 releases the sides of the opening 16 for extraction of the article 34 from the indentation 33. The seat cushion 10 can then be used for seating purposes either with the article 34 being reinserted into the indentation 33 or with said article remaining externally of the cushion 10.

As illustrated in FIG. 4, the ribbed seams 31 serve to retain the strap in its stored position due to the over-all resiliency of the cushion and the dimensional characteristics of the strap 24 which may be slightly less than the distance between the buttons 26 around the bottom of the cushion. The opening 16 enables removal of the cover 30 which facilitates laundering or interchange of one cover with another thus enabling the user to conform the ornamental characteristics of the cushion to that of their garments or accessories. The strap may be adjustable in length to facilitate the cushion being carried in the manner of a shoulder bag. As illustrated, the pocket 20 extends about one half of the vertical height of the cushion and may be provided with a resilient member in the upper edge to retain the pocket closed in order to keep articles, such as a bingo ink dauber, therein.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A combined seat cushion and article carrier, comprising:

cushion body means having a recess formed in one major surface face thereof for receiving at least one article therein;

covering means for encasing at least a portion of the cushion body means, said covering means having an opening formed therein and surmounting at least a portion of the recess in the cushion body means, the opening providing access to the recess from externally of the covering means; and, a strap adapted to be grasped by or worn over the shoulder of a user, the ends of the strap being connected to the periphery of the seat cushion at two spaced points, the strap being of a length substanially equal to the larger perimetric distance taken about the periphery of the seat cushion between the spaced points of connection of the strap to said seat cushion.

2. The seat cushion of claim 1 and further comprising releasable fastening means for connecting the ends of the strap to the seat cushion.

3. A combined seat cushion and article carrier, comprising:

a container member;

cushion body means having a recess formed in one major surface face thereof for receiving the container member flushly therewithin over wall portions of the recess, the recess being dimensionally and conformationally congruent with the shape of the container member; and, covering means for encasing at least a portion of the cushion body means, said covering means having an opening formed therein and surmounting at least a portion of the recess in the cushion body means, the opening providing access to the recess from externally of the covering means.

4. The combined seat cushion of claim 3 and further comprising:

a strap adapted to be grasped by or worn over the shoulder of a user, the ends of the strap being connected to the periphery of the seat cushion at two spaced points, the strap being of a length substantially equal to the larger perimetric distance taken about the periphery of the seat cushion between the spaced points of connection of the strap to said seat cushion.

5. The seat cushion of claim 3 wherein the recess is shaped in the form of the frustum of a right circular cone.

6. The seat cushion of a claim 3 and further comprising zipper means attached to the covering means along the opening for opening and closing the opening.

7. The seat cushion of claim 3 and further comprising means for forming on at least one face of the covering means a pocket.

* * * * *